United States Patent [19]

Kessler

[11] Patent Number: 4,718,364

[45] Date of Patent: Jan. 12, 1988

[54] SEWING MACHINE HAVING A WASTE MATERIAL CONTAINER

[75] Inventor: Rolf Kessler, Karlsruhe-Durlach, Fed. Rep. of Germany

[73] Assignee: Dorina Nähmaschinen GmbH, Fed. Rep. of Germany

[21] Appl. No.: 51,869

[22] Filed: May 19, 1987

[30] Foreign Application Priority Data

May 28, 1986 [DE] Fed. Rep. of Germany ... 8614429[U]

[51] Int. Cl.[4] ..... D05B 37/00

[52] U.S. Cl. ..... 112/122; 112/259; 112/287

[58] Field of Search ..... 112/259, 258, 122, 287

[56] References Cited

U.S. PATENT DOCUMENTS 2,893,336 7/1959 Chinnici ..... 112/122 X 3,434,438 3/1969 Forrest et al. ..... 112/122 X 4,138,957 2/1979 Blessing et al. ..... 112/287

4,328,758 5/1982 Souza et al. ..... 112/287 X

*Primary Examiner*—Ronald Feldbaum

*Attorney, Agent, or Firm*—McGlew and Tuttle

[57] ABSTRACT

A sewing machine has a trimmer and a waste container for trimmed waste fed to it through a guide groove. The waste container that needs little space and also enlarges the workpiece support surface for the sewing material is designed and arranged so that the trimmed waste reaches it over short transport paths. For this purpose, a portion of the sewing machine includes the waste container located beside the trimmer and reaching directly to it, whose top is aligned with a base top plate covering the rest of the base of the sewing machine and together with it forms a support surface for the sewing material.

8 Claims, 5 Drawing Figures

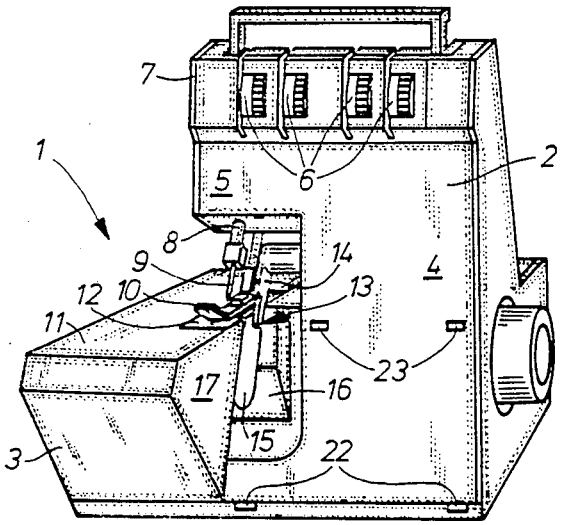
Fig. 2
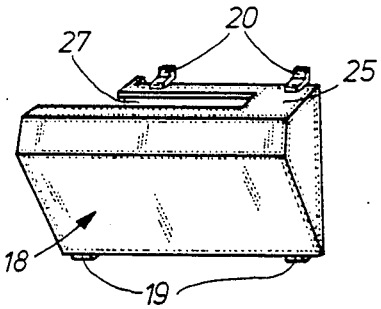
Fig. 4
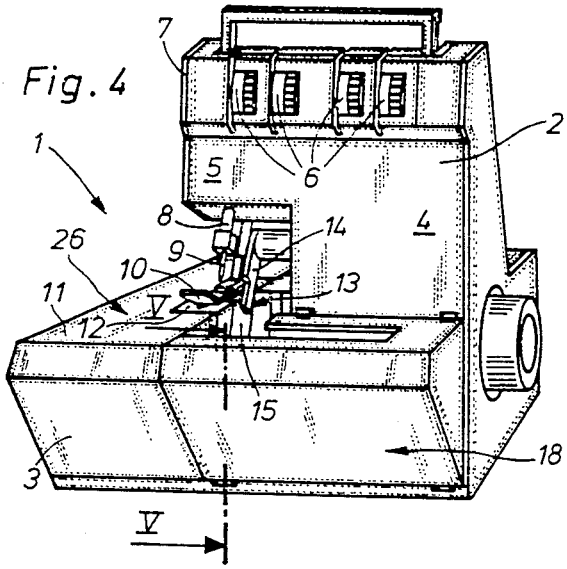
Fig. 5
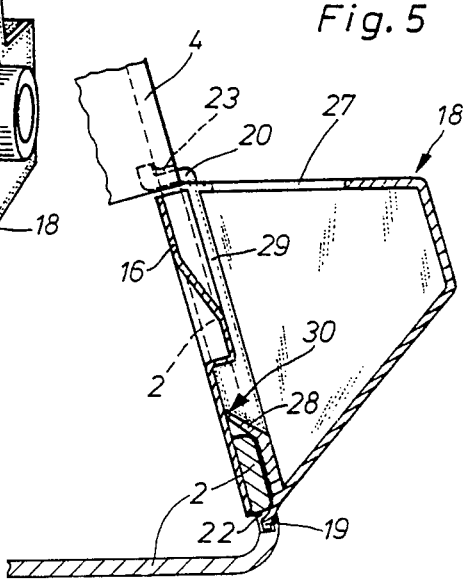
Fig. 3
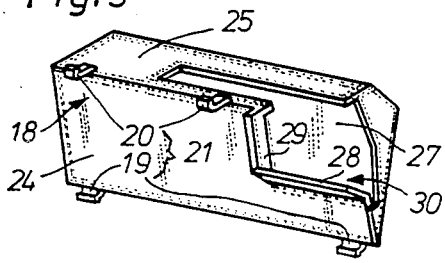

SEWING MACHINE HAVING A WASTE MATERIAL CONTAINER

FIELD AND BACKGROUND OF THE INVENTION

This invention relates in general to sewing machines and in particular to a new and useful sewing machine having a housing base portion with a removable container for accepting waste material produced during sewing and trimming.

A sewing maching is disclosed by U.S. Pat. No. 3,084,647 that is provided with a trimmer. The trimmed waste cut off by the trimmer passes a tube that is connected to a bag as a waste container to hold the trimmed waste. The trimmed waste is transported through the tube into the waste container by a stream of air that is generated by a fan driven by the motor of the sewing machine.

In this arrangement, the long transport paths between the trimmer and the waste container are a disadvantage, since the trimmed waste clings to the tube without the stream of air and does not reach the waste container. This is a particular drawback especially for domestic sewing machines, since there is generally no source of compressed air in the household and a fan driven by the motor of the sewing machine is costly and expensive for use in the home. The freedom of motion of the seamstress is also restricted by the tube and the waste container, and the appearance of the sewing machine is adversely affected.

The invention provides a waste container for trimmed waste of a sewing machine arranged so that the trimmed waste reaches the waste container over short transport paths that need as little space as possible, and the support surface for the sewing material is enlarged without changing the appearance of the sewing machines.

The waste container is advantageously integrated into the housing of the sewing machine, and in addition to its actual function, that is to hold trimmed waste, it serves as a panelling element that produces an enlargement of the support surface for the sewing material in the stitching area. This facilitates the guidance of the sewing material by the seamstress. At the same time, an optimally short path length is provided for the trimmed waste.

Because of the desired short path length, the opening provided in the waste container includes an arrangement in which the cut-off fabric strips and threads fall directly into the waste container. The entrance of the trimmed waste falling down laterally from the stitching plate into the waste container is facilitated, inasmuch as a guide groove is provided which reduces the risk that trimmed waste will accumulate below the opening in the entry area or will be suspended there, which would block the path for the following trimmed waste to the interior of the waste container.

It is possible easily to empty the waste container that is filled with trimmed waste after some time of sewing, by forming it as an independent unit that can be removed from the sewing machine.

The support surface for the sewing material is advantageously enlarged by the waste container in the area that is especially important for laying and guiding the sewing material.

Accordingly, it is the object of the invention to provide a sewing machine with a removeable waste container which is adapted to be detachable, secure to the sewing machine housing which defines a receiving groove for waste material at a surface which is flush with the sewing machine housing base which goes to define a greater article support surface with the base.

A further object of the invention is to provide a sewing machine which is simple in design, rugged in construction and economical to manufacture.

BRIEF DESCRIPTION OF THE DRAWINGS

In the drawings:

FIG. 1 is a front top perspective view of a sewing machine constructed in accordance with the invention;

FIGS. 2 and 3 are respective opposite side perspective views of the waste container for the sewing machine;

FIG. 4 is a perspective of the sewing machine with the waste container;

FIG. 5 is a view taken along the line V—V of FIG. 4, in partial cross section.

DESCRIPTION OF THE PREFERRED EMBODIMENTS

Referring to the drawings in particular, the invention embodied therein comprises a sewing machine generally designated 1 which has a housing or frame for the base portion 3 which has a workpiece support base top 11 as well as a housing upright portion 2 and a housing arm portion 5 extending outwardly from the upright portion which overlies the base portion 3. The sewing needle 9 is mounted in the housing for vertical reciprocation and is moveably mounted above the base portion 11 to sew a workpiece moveable over the base portion. A trimmer 13 carried by the housing is operable to trim the material from the workpiece alongside the base portion.

In accordance with the invention the detachable waste container 18 is engagable with the housing and has a waste container top 25 with a waste material receiving slot 27 which, when attached to the housing lies adjacent the needle 9 and below the trimmer 13 for receiving materials cut by the trimmer. Waste container 18 has a waste container top 25 which is alignable with the workpiece support base top 11 so as to define a large workpiece support top therewith.

The sewing machine 1 shown in FIG. 1 is an overlock machine whose housing 2 includes a base 3, a frame or central housing arm 4, and an arm 5 that holds the thread tension devices 6. The arm 5 changes into a head 7 in which is mounted a needle bar 8 driven in a known way that carries a thread-guiding needle 9. The sewing machine 1 is provided with an upper fabric feeder 10 and a lower fabric feeder, not shown, to transport the sewing material.

The base 3 is covered by a base plate 11 in which is held a stitching plate 12. Just to the right of the stitching plate 12 (FIG. 1) there is a trimmer 13 that has a driven cutting knife 14 and a counterknife 15 to cut off sewing material or threads. A slide 16 for the trimmed waste cut off by the trimmer 13 and falling down is provided in the base. The slide 16 is bounded by a side wall of the base 17 on the left side in FIG. 1.

A waste container 18 to hold the trimmed waste is fastened to the housing 2 (FIG. 4). The waste container 18 includes ledges 19 at its bottom and hooks 20 at its top (FIGS. 2 and 3). The ledges 19 together with the hooks 20 form retainers 21. To fasten the waste container 18 to the housing 2, the ledges 19 engage in grooves 22 and the hooks 20 in recesses 23 in the housing 2, with the rear wall 24 of the waste container 18 resting against the housing 2.

The waste container 18 has a top 25 that together with the base plate 11 forms a support surface 26 for the sewing material. There is an opening 27 in the top 25 extending partly to the rear 24 of the waste container 18. There is also a guide face 28 on the rear wall 24, which is followed by an edge strip 29 next to it on the side. After attaching the waste container 18 to the housing 2, the guide face 28 together with the edge strip 29 and the base wall 17 form a guide groove 30 that is located just beneath the slide 16 (FIG. 5). The device operates as follows:

The sewing material to be machined is placed on the support surface 26 in a known way. Before the edge of the sewing material is stitched, it is cut straight by the trimmer 13 so that the sewing material can be provided with a clean edge.

The fabric strips cut off from the sewing material and pieces of thread cut off fall down as trimmed waste beside the stitching plate 12 and strike the slide 16. This carries the trimmed waste further in such a way that it moves toward the waste container 18 and reaches it through the opening 27.

The guide groove 30 is provided below the slide 16 so what the trimmed waste is still guided after entering the waste container and does not accumulate beneath the slide 16. This distributes the trimmed waste adequately even when the waste container 18 is partly filled.

To remove the waste container 18, it is moved toward the recesses 23 in which the hooks 20 are engaged with clearance at their tops. This pulls the ledges 19 out of the grooves 22, after which the waste container 18 is pivoted around the hooks 20 as a center of rotation, and away from the housing 2, until the hooks 20 can be withdrawn from the recesses 23. The waste container 18 can then be taken off and emptied.

To replace it, the hooks 20 are again inserted in the recesses 23 and the waste container 18 is then pivoted toward the housing until the ledges 19 latch into the grooves 22.

What is claimed is:

1. A sewing machine, comprising a base having a top base blade, a trimmer operable to the said base, and a waste container for trimmed waste having a guide groove for the waste, a portion of said base defining said waste container being located below said trimmer and extending directly to said trimmer and having a container top aligning with said top base blade and covering the rest of said base and falling together with said base of the support surface for the sewing material.

2. A sewing machine according to claim 1 wherein said container top has an opening extending at least partly to a rear wall thereof with a passage of the trimmed waste.

3. A sewing maching according to claim 1 wherein said container has a rear wall with a guide face which together with a wall of said base which is adjacent to has a side with an edge strip forming a guide groove for trimmed waste.

4. A sewing machine according to claim 1 wherein said waste container in said housing having defined retaining means for holding said container detachably in position adjacent said base.

5. A sewing machine according to claim 1 wherein the retaining means include retainers in the forms of ledges carried by said container and said sewing machine have said housing with grooves therein for receiving said ledges and including hooks carried in adjacent the upper end of said containers and housing having recesses into which said hooks engage.

6. A sewing machine according to claim 1 wherein said waste container is located on one side of said housing of said sewing machine said housing including feeding means for feeding material over the top of said base adjacent to said waste container.

7. A sewing machine, comprising a housing having a housing base portion with a workpiece support base top, a housing upright portion with a housing arm portion overlying said housing base portion, a sewing needle mounted on said housing for movement over said base portion to sew a workpiece moveable over said base portion with the workpiece support base top, a trimmer carried by said housing and operable to trim material from the workpiece along sides and base portion, and a detachable waste container engageable with said housing and having a container top with a waste material receiving slot which when attached to said housing lies adjacent to said needle and below said trimmer for receiving material cut by said trimmer, said waste container top being aligned with said workpiece support base top so as to define a large workpiece support base top therewith.

8. A sewing machine according to claim 7 wherein said waste container includes support ledgers projecting outwardly adjacent the bottom edge thereof, said housing including a wall with a space recess for engaging respective ledgers, said waste container having upper ends with projecting hinge members at space locations, said housing having space recesses for receiving said hinge members, said container having a wallslide adjacent said housing defining a plurality of edge strip engagable against said housing frame and defining a guide slot continuation of the slot of the said container.

* * * * *